US006354237B1

(12) United States Patent
Gaynor et al.

(10) Patent No.: US 6,354,237 B1
(45) Date of Patent: Mar. 12, 2002

(54) COORDINATED TRIM TAB CONTROL SYSTEM FOR A MARINE VESSEL HAVING PORT AND STARBOARD TRIM TABS

(75) Inventors: Phillip K. Gaynor, Fond du Lac; Steve L. Van Camp, Cascade, both of WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 09/685,461

(22) Filed: Oct. 9, 2000

(51) Int. Cl.[7] ..... B63B 1/22
(52) U.S. Cl. ..... 114/286; 114/121
(58) Field of Search ..... 114/284–287, 121, 114/122, 126, 275

(56) References Cited

U.S. PATENT DOCUMENTS

| | | | | |
|---|---|---|---|---|
| 3,695,204 A | * | 10/1972 | Bennett | |
| 4,323,027 A | | 4/1982 | Schermerhorn | 114/285 |
| 4,644,893 A | | 2/1987 | Zepp | 114/286 |
| 5,113,780 A | | 5/1992 | Bennett et al. | 114/286 |
| 5,215,029 A | | 6/1993 | Davis | 114/274 |
| 5,263,432 A | | 11/1993 | Davis | 114/286 |
| 5,385,110 A | | 1/1995 | Bennett et al. | 114/285 |
| 5,474,012 A | | 12/1995 | Yamada et al. | 114/286 |
| 5,474,013 A | | 12/1995 | Wittmaier | 114/286 |
| 6,273,771 B1 | * | 8/2001 | Buckley et al. | 440/84 |

* cited by examiner

*Primary Examiner*—Sherman Basinger
(74) *Attorney, Agent, or Firm*—William D. Lanyi

(57) ABSTRACT

A trim tab control system is provided in which four buttons or switches are provided for the marine operator in which the operator can select to raise the bow, raise the stern, raise the port side of the boat, or raise the stern side of the boat in relative terms, and the system will automatically position the trim tabs to most efficiently achieve the operator's demanded change in position of the marine vessel.

14 Claims, 4 Drawing Sheets

COORDINATED TRIM TAB CONTROL SYSTEM FOR A MARINE VESSEL HAVING PORT AND STARBOARD TRIM TABS

BACKGROUND OF THE INVENTION

1. Field of the Invention

The present invention is generally related to a control system for controlling the positions of trim tabs on a marine vessel and, more particularly, to a coordinated trim tab control system that responds to a manually generated vessel trim tab command signal and selects preferred positions for both the port and starboard trim tabs that are chosen as a function of the current trim tab positions and the efficient operation of the marine vessel.

2. Description of the Prior Art

Various types of trim tabs and similar devices are well known to those skilled in the art and have been used to adjust the position and attitude of marine vessel, relative to the body of water on which they are operating, by adjusting the relative positions of the bow and stern and the relative positions of the port side of the vessel to the starboard side of the vessel. Trim tabs are used to lower or raise the bow of a marine vessel, particularly when the marine vessel is operating on plane. Furthermore, trim tabs have been used to adjust the port or starboard list of the marine vessel.

U.S. Pat. No. 5,385,110, which issued to Bennett et al on Jan. 31, 1995, describes a boat trim control and monitor system. The system includes a boat having a hull and a means, such as trim tabs, mounted to the hull for trimming the attitude of the boat as the hull is propelled through the water. The system includes the facility for selectively adjusting the trim tabs to maintain a desired boat attitude under varying load and sea conditions. A sensor is mounted on the boat hull to provide an electrical sensor signal as a function of boat attitude and is connected to electronic control circuitry that is responsive to the sensor signal for determining the attitude of the boat hull. This electronic control circuitry further includes facility for operator setting of a desired boat attitude. The electronic control circuitry is coupled to an operator display for indicating departure of actual boat attitude indicated by the sensor from the boat attitude desired by the operator, and/or to automatic control circuitry for automatically varying trim tab orientation with respect to the boat hull so as to maintain the boat attitude desired by the operator.

U.S. Pat. No. 5,113,780, which issued to Bennett et al on May. 19, 1992, describes an automatic boat trim tab control. The system includes a pair of trim tabs pivotally mounted to the stern of a boat hull, and an engine responsive to application of electrical ignition power for powering the boat through the water. A pair of fluid actuators extend between the hull and the respective trim tabs for selectively and adjustably moving the tabs between full extended and full retracted positions. A fluid drive is responsive to a boat operator for selectively adjusting positions of the trim tabs independently of each other to maintain a desired attitude of the boat hull. Electronic control circuitry is responsive to removal of ignition power from the engine for operating the fluid drive and energizing the actuators for a predetermined time duration so as to move boat trim tabs to the fully retracted position upon removal of ignition power from the engine.

U.S. Pat. No. 5,263,432, which issued to Davis on Nov. 23, 1993,describes an automatic trim tab control for power boats. Adjustment of a power boat's trim tabs is automated throughout all phases of the operation of the boat. The boat's speed and/or revolutions of its engine is sensed and used by electronic circuits, including a microprocessor-based circuit, to control prime movers, typically hydraulic pumps, in order to move the trim tabs to their optimal positions. In one embodiment of the invention, the boat speed is sensed by a speedometer. Below a first predetermined speed, the trim tabs are moved fully downward. Above a second predetermined speed, the trim tabs are moved fully upward.

U.S. Pat. No. 5,474,013, which issued to Wittmaier on Dec. 12, 1995,describes a trim tab auto-retract and multiple switching device. In includes a circuit for causing the trim tabs attached to the stern of a hull of a motorized marine vessel to be automatically fully retracted by activating means independently of the boat ignition switch to cause a capacitor in the circuit to discharge. The means can include at least one switch connected between the capacitor and an electrical power source to which the control circuit can be connected such that the means are activated when the switch is opened.

U.S. Pat. No. 5,474,012, which issued to Yamada et al on Dec. 12, 1995, describes an automatic control for trim tabs. Adjustment is made of the position of the marine transportation system including a boat having a drive, a trimmable port tab and a trimmable starboard tab. The operation of the marine transportation system is monitored to provide an output distinguishing boat operation in an on-plane condition and boat operation in an off-plane condition, to provide an output distinguishing boat travel in a straight forward condition and boat travel in a turning condition and to provide an output distinguishing boat operation in a first heel condition in which the boat tilts to port and boat operation in a second heel condition in which the boat tilts to starboard.

U.S. Pat. No. 4,644,893, which issued to Zepp on Feb. 24, 1987, describes a position indicating apparatus for use in a boat leveling system. The boat leveling system has a pair of trim tabs pivotal between a horizontal position and a downwardly incline position. Each trim tab is movable between the horizontal and inclined positions by a separate fluid motor which includes a cylinder, a piston slidably disposed in the cylinder and a rod connected to the piston. The position of each trim tab is indicated by apparatus which includes a linear potentiometer attached to the rod of the associated fluid motor, the potentiometer having a flexible plastic envelope and a pair of normally spaced-apart conductive strips sealed in the envelope, a ball and spring carried by the cylinder for contacting the envelope and forcing the strips into an electrical contact with each other, and a resistance measuring device connected in circuit with the potentiometer and to provide a readout in degrees of the downward angle from horizontal of the trim tab.

U.S. Pat. No. 4,323,027, which issued to Schermerhorn on Apr. 6, 1982, describes a trim tab for a power boat. The inventive trim tab is formed of a single piece of tough, rigid resin providing an integral mounting plate and a lifter extending aft from a bottom region of a power boat transom. A mounting plate is formed flat to fit against the transom. The lifter extends aft from the mounting plate at about a right angle and has a trailing region curving down around a transverse axis aft of the mounting plate and below the lifter. A pair of semi-tubular surfaces incline from an upper region of the mounting plate down to the curved region of the lifter. The lifter also has side edges that extend downwardly and run aft from the transom and has a downwardly extending ridge that runs aft between semi-tubular surfaces.

U.S. Pat. No. 5,215,029 which issued to Davis on Jun. 1, 1993, describes a hydroplaning boat accessory. A permanently fixed metal trim tab for attachment in pair combinations to the aft end of a boat is described. Each trim tab comprises a downwardly extending aft edge. A top surface of each trim tab comprises an aft area which comprises striations which provide an anti-slip surface. The strength, position of attachment to the boat, and anti-slip surface permit use of the trim tab as a step for entry and exit to and from the boat. Each trim tab comprises a flange for attachment to a transom of the boat from connecting points above and below an aftwardly extending substantially flat plate of the trim tab which is an integral part of the flange. The trim tab comprises a uniform cross section which is compatible with fabrication by an extrusion process.

It would be beneficial if a trim tab control means could be provided which coordinates the movement of two or more trim tabs, with consideration to the present position of the trim tabs and further consideration to the efficient operation of the boat, in response to a manually provided command signal which indicates a desire on the part of the marine vessel operator to affect the position of the vessel while operating at planing speeds. It would also be significantly beneficial if the marine vessel operator did not have to individually select the position of the port and starboard trim tabs but, instead, could move simply command a coordinated change in attitude of the vessel.

SUMMARY OF THE INVENTION

A preferred embodiment of the present invention provides a coordinated trim tab control method for a marine vessel having port and starboard trim tabs, wherein the method comprises the steps of sensing the port and starboard trim tabs positions, receiving a manually generated vessel trim command signal, determining a preferred coordinated movement of both the port and starboard trim tabs as a function of the manually generated vessel trim command signal in combination with the positions of the port and starboard trim tabs, and then providing port and starboard trim tab output signals to the trim tabs actuators to achieve the preferred coordinated movement.

In a preferred embodiment of the present invention, the determining step comprises the steps of comparing the port trim tab position to a predetermined maximum range of movement of the port trim tab, comparing the starboard trim tab position to a predetermined maximum range of movement of the starboard trim tab, and then determining a preferred magnitude of coordinated movement of both port and starboard trim tabs as a function of the manually generated vessel trim tab command signal and the relationships of the positions of both the port and starboard trim tabs to their respective maximum ranges of movement.

In a preferred embodiment of the present invention, the manually generated vessel trim command signal is a manually selected one of a plurality of commands comprising a "raise bow relative to stern" command, a "lower bow relative to stern" command, a "raise the port side of the vessel relative to the starboard side of the vessel" command, and a "raise the starboard side of the vessel relative to the port side of the vessel" command. The manually generated vessel trim common signal can be received from a track pad component comprising four individual switches. The track pad component can comprise a first switch to raise the bow, a second switch lower the bow, a third switch to raise the port side of the vessel relative to the starboard side of the vessel, and a fourth switch to raise the starboard side of the vessel relative to the port side of the vessel.

The determining step of the present invention can comprise a step of minimizing the magnitude of actuation of both port and starboard trim tabs to minimize the drag on the vessel while determining a preferred magnitude of movement of the port and starboard trim tabs. In other words, the control unit of the present invention can determine the most efficient positions of the port and starboard trim tabs that will satisfy the command received from the vessel operator. In most situations, this most efficient position of each trim tab is a position in which the trim tabs are least extended into the water behind the vessel and most fully retracted from that extended position.

BRIEF DESCRIPTION OF THE DRAWINGS

The present invention will be more fully and clearly understood from a reading of the description of the preferred embodiment in conjunction with the drawings, in which.

DESCRIPTION OF THE PREFERRED EMBODIMENT

Figure 1:
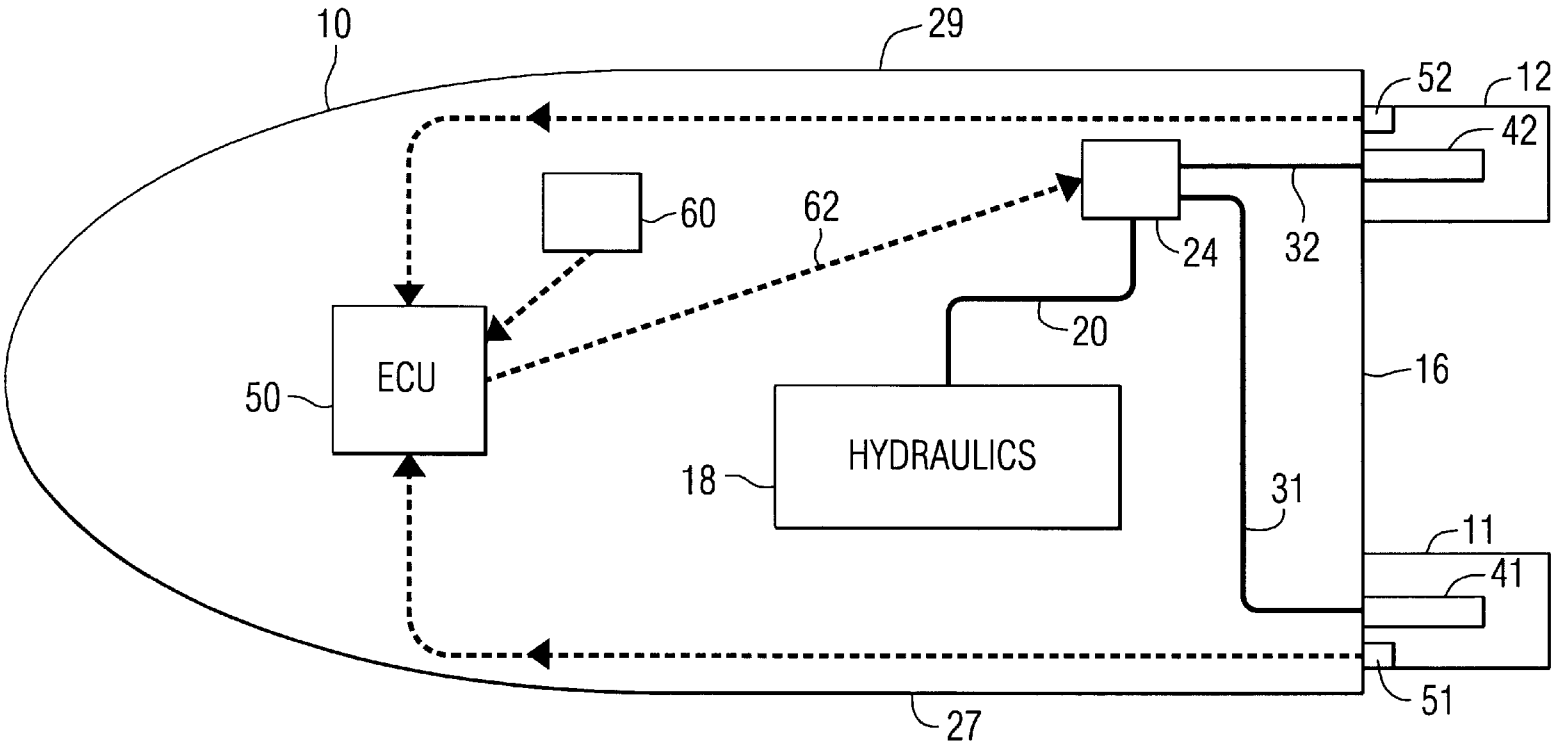
FIG. 1 is a schematic representation of a marine vessel with a trim tab system made in accordance with the present invention.

Throughout the description of the preferred embodiment of the present invention, like components will be identified by like reference numerals.

FIG. 1 is a highly simplified schematic illustration of a marine vessel 10 with trim tabs, 11 and 12, pivotally attached to the stern 16 of the marine vessel 10. A hydraulic system 18 provides hydraulic pressure, in line 20, that is controlled by a valve 24 and selectively distributed, through lines 31 and 32, to hydraulic actuators 41 and 42. The hydraulic actuators, 41 and 42, can be hydraulic cylinders which are attached to both the transom 16 and the two trim tabs, 11 and 12.

With continued reference to FIG. 1, an engine control unit 50 receives signals from two position sensors, 51 and 52, which are provided so that the engine control unit 50 can determine the current position of both trim tabs, 11 and 12. A manual command input device 60 allows the operator of the marine vessel 10 to enter a manual command, as a manually generated vessel trim command signal, which is received by the engine control unit 50. The engine control unit 50, in turn, can provide a signal on line 62 to the hydraulic valve 24 which directs the hydraulic fluid proportionally through lines 31 and 32 to achieve the desired positioning of the trim tabs, 11 and 12. It should be understood that the manually generated vessel trim command signal does not, in itself, dictate the precise positions of the port trim tab 11 or the starboard trim tab 12. Instead, the manually generated vessel trim command dictates the desired position of the marine vessel 20 relative to the body of water on which it is operated. The manually generated vessel trim command can represent a relative height of the bow relative to the stern or the relative height of the port side of the marine vessel 10 in comparison to the starboard side of the marine vessel 10. The engine control unit 50 receives the manually generated vessel trim command signal and determines the appropriate coordinated changes required in the positions of the port and starboard trim tabs, 11 and 12.

Figure 2:
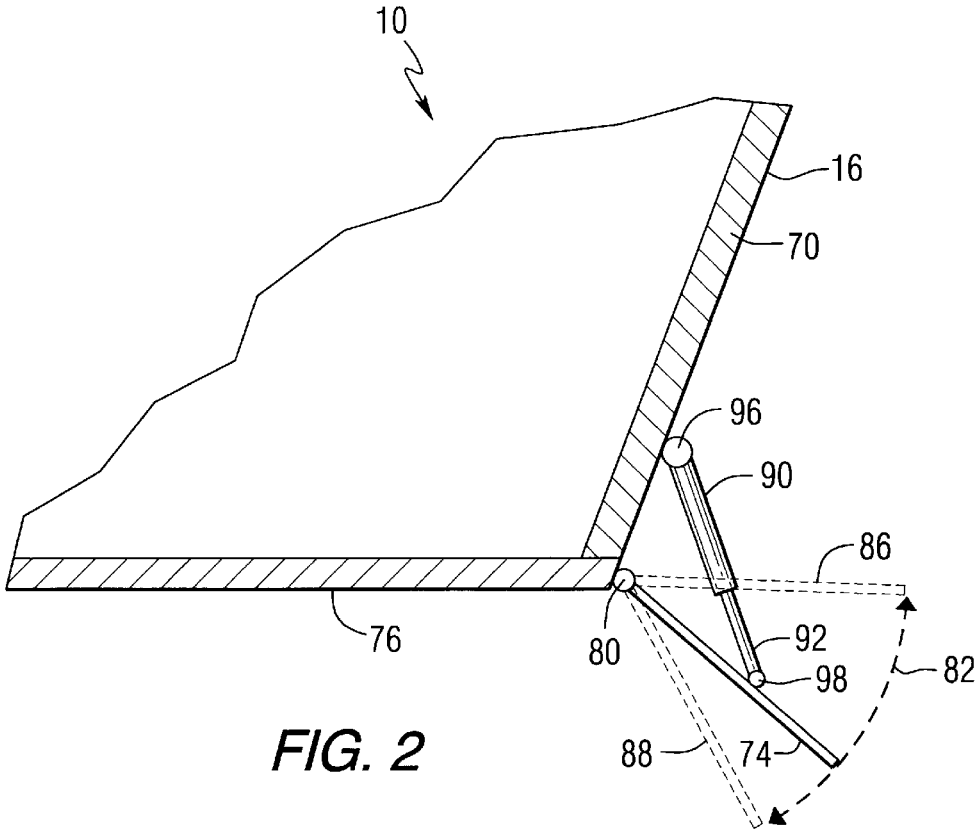
FIG. 2 is a side view of a marine vessel which shows the position of a trim tab and its potential range of travel.

FIG. 2 is a schematic representation of the transom 70 at the stern 16 of a marine vessel 10. FIG. 2 shows a single trim tab 74 attached to the transom 70 at a location near the bottom 76 of the marine vessel 10. The trim tab 74 is pivotally mounted, at a hinge 80, and is able to pivot through a range of positions, as represented by arrow 82. The dashed lines in FIG. 2 represent a fully retracted position 86 of the trim tab 74 and a fully extended position 88. A hydraulic cylinder 90 is associated with a piston rod 92 that allows the trim tab 74 to be moved about its pivot 80. The hydraulic cylinder 90 is attached for rotation, at point 96, at the transom 70 and also, at point 98, to the trim tab 74.

The illustration of FIG. 2 is intended to allow a more definitive description of the operation of a trim tab 74. It should be understood that the trim tab 74 in FIG. 2 represents both the port trim tab 11 and the starboard trim tab 12 in FIG. 1. Similarly, the hydraulic cylinder 90 in FIG. 2 represents both the hydraulic cylinder 41 and the hydraulic cylinder 42 in FIG. 1. The position sensors, 51 and 52, described above in conjunction with FIG. 1 are not shown in FIG. 2, but it should be understood that position sensors are used during the performance of the present invention in order to determine the current position of each trim tab. This function can also be provided by the ECU 50 by keeping track of previous movements and by periodically retracting the tabs to reset the position value.

With continued reference to FIG. 2, it should be understood that the operation of the marine vessel 10 is more efficient when the trim tab 74 is fully retracted to the position identified by reference numeral 86. It should also be understood, as is well known to those skilled in the art, that an extended trim tab 74, as identified by reference numeral 88 in FIG. 2, creates an upward force on the transom 70 at a point through the pivot 80. Therefore, if a port trim tab 11 is extended downward, an upward force is exerted at the port trim tab 11 on the transom 70 and this causes the port side of the marine vessel 10 to rise in relation to the starboard side of the marine vessel. Similarly, an extended starboard trim tab 12 would create an upward force on the starboard side of the transom 70 and raise the starboard side of the marine vessel 10 relative to the port side.

Figure 3:
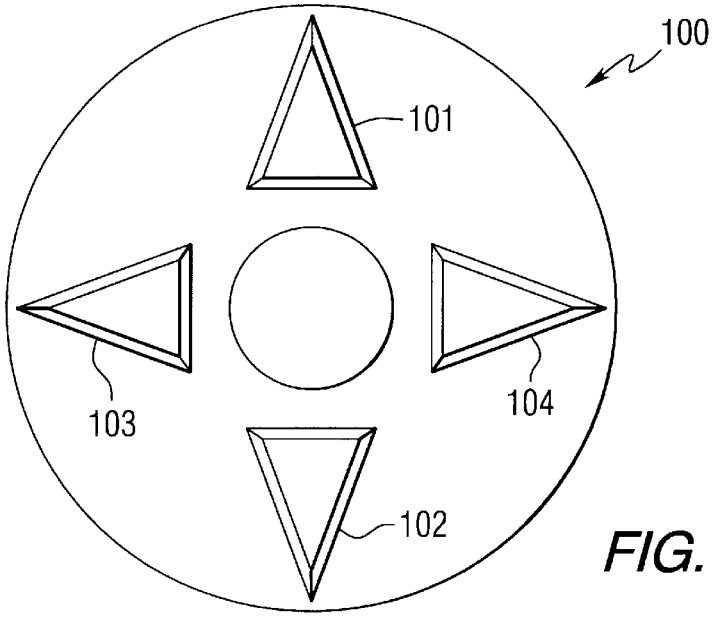
FIG. 3 shows a track pad display that can be used in accordance with the present invention.

With continued reference to FIGS. 1 and 2, it should also be understood that the upward forces exerted against the transom 70 by extended trim tabs also raise the stern 16 of the marine vessel 10 relative to its bow. FIG. 3 shows an input device with which a marine vessel operator can enter the manually generated vessel trim command. The switch device 100 is typically mounted on a dashboard of the marine vessel at a location that is readily accessible by the operator of the marine vessel. Four push buttons are used to actuate four switches to provide signals to the engine control unit 50, as described above in conjunction with FIG. 1. A first switch 101 is used to command the trim tab control system to raise the bow relative to the stern 16. A second switch 102 is used to send a signal to the engine control unit 50 to lower the bow relative to the stern. The third switch 103 is used to provide a signal to the engine control unit 50 to raise the port side of the vessel relative to the starboard side of the vessel. A fourth switch 104 is used to provide a command that tells the engine control unit 50 to raise the starboard side of the vessel relative to the port side of the vessel.

With reference to FIGS. 1, 2, and 3, it should be understood that the port side of the vessel 27 can be raised relative to the starboard side of the vessel 29 in several alternative ways. First, the port trim tab 11 can be extended downward, as represented by reference numeral 88 in FIG. 2 without changing the position of the starboard trim tab 12. Alternatively, if the starboard trim tab 12 is currently extended downward as a result of a previous manually generated vessel trim command, the port side 27 of the marine vessel can be raised relative to the starboard side 29 by retracting the starboard trim tab 12 from its currently extended position. Alternatively, if both the port trim tab 11 and starboard trim tab 12 are partially or completely extended downward, as represented by reference numeral 88 in FIG. 2, the port side 27 of the marine vessel can be raised relative to its starboard side 29 by the combined movement of the port trim tab 11 downward and the starboard trim tab 12 upward. Another consideration that is important in the adjustment of the trim tabs in response to manually generated vessel trim command is the overall efficient operation of the marine vessel 10. If a choice of movements of the trim tabs is available to the engine control unit 50, a combined or coordinated movement of the port and starboard trim tabs, 11 and 12, which result in the least required combined extension downward of both trim tabs. In other words, a combination of trim tab movements that leave the two trim tabs in a more retracted position is preferable to a combination of movements that leaves the trim tabs in a more extended position, even though both options result in the same trim condition of the marine vessel 10. This is true because the lesser extended positions of the trim tabs result in a more efficient operation of the marine vessel than an alternative arrangement in which the trim tabs are more fully extended downward into the water, as represented by reference numeral 88 in FIG. 2, because of the increased drag on the marine vessel 10 that results from this more fully extended position.

Figure 4A:
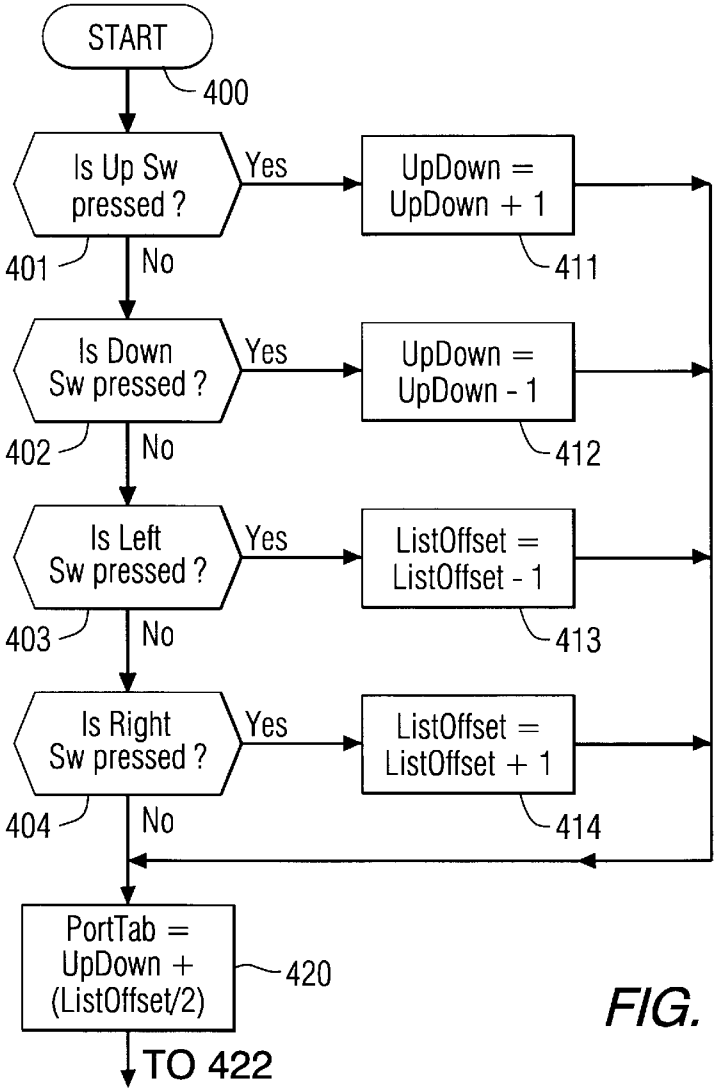
FIGS. 4A and 4B show a functional block flowchart of a control scheme that can be used in conjunction with the present invention.
Figure 4:
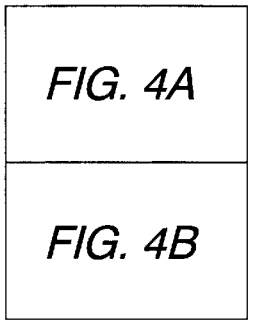
FIG. 4 shows the relationship of FIGS. 4A and 4B with respect to each other.
Figure 4B:
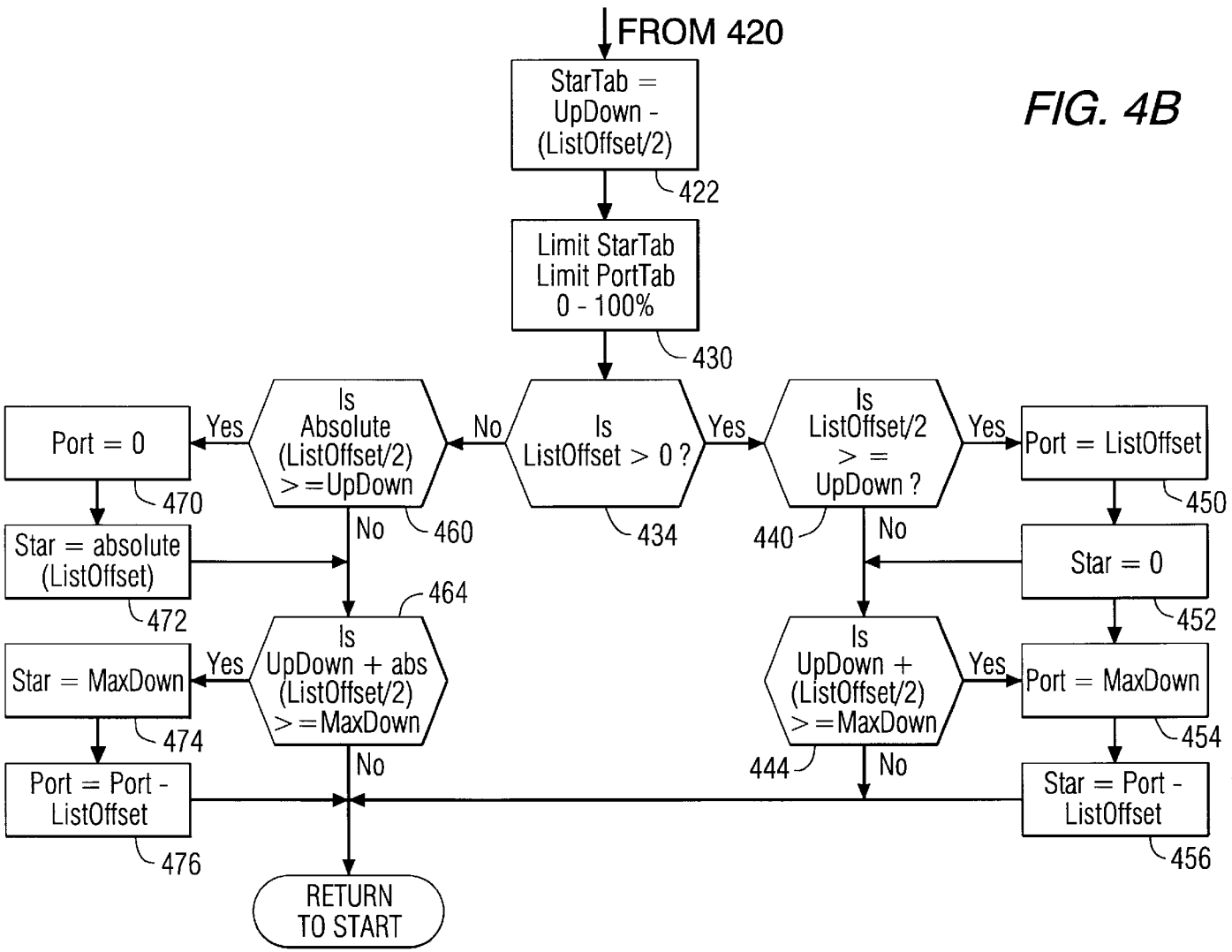

FIGS. 4A and 4B show an exemplary flowchart which is functional in nature and describes one possible control scheme for incorporating the present invention with a marine vessel. After starting at functional block 400, the software first checks the four buttons, 101–104, and determines if any one of them is pressed. This is illustrated in functional blocks 401–404. If either the up switch or down switch is depressed, the UPDOWN value is incremented or decremented, as shown in functional blocks 411 and 412, respectively. If the left or right switches are depressed, as interrogated in functional blocks 403 and 404, the LISTOFFSET value is either decremented or incremented, as shown in functional blocks 413 and 414, respectively. After interrogating the switches and setting the UPDOWN and LISTOFFSET values appropriately, the software then updates the PORTTAB and STARTAB position set points, as shown in functional blocks 420 and 422. The limits for the two trim tab ranges of travel are then checked at functional block 430. At functional block 430, the software determines whether or not the marine vessel operator has depressed a switch for a time duration that attempts to exceed the maximum possible demanded movement of the trim tabs.

With continued reference to FIGS. 4A and 4B, the LISTOFFSET value is checked to determine whether it is greater than zero at functional block 434. If it is greater than zero, the path of the magnitude of the LISTOFFSET value is compared to the UPDOWN value at functional block 440 and then the UPDOWN value plus the half of the LISTOFFSET value is compared to the MAXDOWN magnitude at functional block 444. The functional blocks identified by reference numerals 450, 452, 454, and 456 respond to the determinations made at functional blocks 440 and 444.

If the LISTOFFSET is less than zero as interrogated at functional block 34, the absolute value of half of the LISTOFFSET magnitude as compared to the UPDOWN value at functional block 460 and the UPDOWN value plus half of the LISTOFFSET value is compared to the MAXDOWN value. The functional blocks identified by reference numerals 470, 472, 474, and 476 accommodate the answer to the interrogations of functional blocks 460 and 464.

With continued reference to FIGS. 4A and 4B, it can be seen that the switches are read and the switch values are integrated into the UPDOWN and LISTOFFSET values. If the UPDOWN and LISTOFFSET values either exceed 100 or are less than zero, there are truncated to those values, respectively. The current trim tab position is determined by adding and subtracting half of the magnitude of the LISTOFFSET value to the UPDOWN value and storing these as the port tab position and starboard tab position. At this point, various rules can be implemented to assure that the positioning of the two trim tab follow a predetermined procedure based on their present positions and on the vessel operator's most recent commands. If the LISTOFFSET value is greater than zero, and half of the LISTOFFSET magnitude is greater than or equal to the UPDOWN value, the port tab is moved to the LISTOFFSET position while the starboard tab is moved to its zero or neutral position. Otherwise, if the UPDOWN value plus half of the LISTOFFSET value are greater than the MAXDOWN value than the port trim tab position is set equal to the MAXDOWN value while the starboard tab position is set equal to the port tab position minus the LISTOFFSET value. If the LISTOFFSET value is less than zero and the absolute value of half of the magnitude of the LISTOFFSET value is greater than the UPDOWN value, the port trim tab position is set to zero and the starboard trim tab position is set to the absolute value of the LISTOFFSET value. Otherwise, if the UPDOWN value plus half of the absolute value of the LISTOFFSET is greater than the MAXDOWN value, the port trim tab position is set equal to the starboard trim tab position plus the LIST OFFSET while the starboard trim tab position is set to its MAXDOWN value value.

It should be clearly understood that the control scheme described above in conjunction with FIGS. 4A and 4B is one possible control scheme that can be used to interpret the marine vessel operator's command, as represented by the depressing of buttons 101–104, and position the two trim tabs to achieve the operator's command in the most efficient manner. It should be clearly understood that the present invention differs significantly from the prior art in that it does not require the operator to select the actual positions of the starboard and port trim tabs. Instead, the operator chooses a relative position of the marine vessel and the present invention automatically selects the necessary positions of the port and starboard trim tabs to achieve the operator's command.

Although the present invention has been described with considerable detail and illustrated to show a preferred embodiment, alternative embodiments are also within its scope.

We claim:

1. A coordinated trim tab control method for a marine vessel having port and starboard trim tabs, comprising the steps of:

sensing a port trim tab position;

sensing a starboard trim tab position;

receiving a manually generated vessel trim command signal;

determining a preferred coordinated movement of both said port and starboard trim tabs as a function of said manually generated vessel trim command signal, said port trim tab position, and said starboard trim tab position, said determining step comprising the steps of comparing said port trim tab position to a predetermined maximum range of movement of said port trim tab, comparing said starboard trim tab position to a predetermined maximum range of movement of said starboard trim tab, and determining a preferred magnitude of movement of both of said port and starboard trim tabs as a function of said manually generated vessel trim command signal and the relationships of said positions of said port and starboard trim tabs to their respective maximum ranges of movement;

providing a port trim tab output signal to a port trim tab actuator to achieve said preferred coordinated movement; and providing a starboard trim tab output signal to a starboard trim tab actuator to achieve said preferred coordinated movement.

2. The method of claim 1, wherein:

said manually generated vessel trim command signal is a manually selected one of a plurality of commands comprising a raise bow relative to stern command, a lower bow relative to stern command, a raise the port side of the vessel relative to the starboard side of the vessel command, and a raise the starboard side of the vessel relative to the port side of the vessel command.

3. The method of claim 1, wherein:

said manually generated vessel trim command signal is received from a track pad component comprising four individual switches.

4. A The method of claim 3, wherein:

said track pad component comprises a first switch to raise the bow relative to stern command, a second switch to lower bow relative to stern command, a third switch to raise the port side of the vessel relative to the starboard side of the vessel command, and a fourth switch to raise the starboard side of the vessel relative to the port side of the vessel command.

5. The method of claim 1, wherein:

said determining step comprises the step of minimizing the magnitude of actuation of both port and starboard trim tabs to minimize the drag on said vessel while determining a preferred magnitude of movement of said port and starboard trim tabs by the steps of comparing said port trim tab position to a predetermined maximum range of movement of said port trim tab, comparing said starboard trim tab position to a predetermined maximum range of movement of said starboard trim tab, and determining said preferred magnitude of movement of both of said port and starboard trim tabs as a function of said manually generated vessel trim command signal and the relationships of said positions of said port and starboard trim tabs to their respective maximum ranges of movement.

6. A coordinated trim tab control system for a marine vessel having port and starboard trim tabs, comprising:

means for sensing a port trim tab position;

means for sensing a starboard trim tab position;

means for receiving a manually generated vessel trim command signal, said manually generated vessel trim command signal being a manually selected one of a plurality of commands comprising a raise bow relative to stern command, a lower bow relative to stern command, a raise the port side of the vessel relative to the starboard side of the vessel command, and a raise the starboard side of the vessel relative to the port side of the vessel command;

means for determining a preferred coordinated movement of both said port and starboard trim tabs as a function of said manually generated vessel trim command signal, said port trim tab position, and said starboard trim tab position;

means for providing a port trim tab output signal to a port trim tab actuator to achieve said preferred coordinated movement; and means for providing a starboard trim tab output signal to a starboard trim tab actuator to achieve said preferred coordinated movement.

7. The system of claim 6, wherein:

said means for determining comprises means for comparing said port trim tab position to a predetermined maximum range of movement of said port trim tab, means for comparing said starboard trim tab position to a predetermined maximum range of movement of said starboard trim tab, and means for determining a preferred magnitude of movement of both of said port and starboard trim tabs as a function of said manually generated vessel trim command signal and the relationships of said positions of said port and starboard trim tabs to their respective maximum ranges of movement.

8. The system of claim 6, wherein:

said manually generated vessel trim command signal is received from a track pad component comprising four individual switches.

9. The system of claim 8, wherein:

said track pad component comprises a first switch to raise the bow relative to stern command, a second switch to lower bow relative to stern command, a third switch to raise the port side of the vessel relative to the starboard side of the vessel command, and a fourth switch to raise the starboard side of the vessel relative to the port side of the vessel command.

10. The system of claim 6, wherein:

said means for determining comprises a means for minimizing the magnitude of actuation of both port and starboard trim tabs to minimize the drag on said vessel connected in signal communication with said means for determining a preferred magnitude of movement of said port and starboard trim tabs.

11. A coordinated trim tab control system for a marine vessel having port and starboard trim tabs, comprising:

a control unit;

a port trim tab actuator, attachable to said port trim tab, for causing said port trim tab of said marine vessel to move relative to said marine vessel;

a starboard trim tab actuator, attachable to said starboard trim tab, for causing said starboard trim tab of said marine vessel to move relative to said marine vessel;

a port trim tab sensor for providing a port signal to said control unit which is representative of the position of said port trim tab relative to said marine vessel;

a starboard trim tab sensor for providing a starboard signal to said control unit which is representative of the position of said starboard trim tab relative to said marine vessel;

a set of switches comprising a first switch to provide a first command to said control unit to raise the bow of said marine vessel relative to the stern of said marine vessel, a second switch to provide a second command to said control unit to raise the stern of said marine vessel relative to the bow of said marine vessel, a third switch to provide a third command to said control unit to raise the port side of said marine vessel relative to the starboard side of said marine vessel, and a fourth switch to provide a fourth command to said control unit to raise the starboard side of said marine vessel relative to the port side of said marine vessel; and a command interpreter for receiving any one of said first, second, third, and fourth commands from said set of switches and comparing a received command signal to a position status of said port and starboard trim tabs as sensed by said port and starboard trim tab sensors.

12. The system of claim 11, wherein:

said control unit comprises a microprocessor.

13. The system of claim 12, wherein:

said port and starboard trim tab actuators are hydraulic cylinders.

14. The system of claim 12, wherein:

said command interpreter comprises a software routine.

* * * * *